US005924298A

United States Patent [19]

Yoo

[11] Patent Number: 5,924,298

[45] Date of Patent: Jul. 20, 1999

[54] CONTROL METHOD OF DEFROSTING OPERATION OF A REFRIGERATOR

[75] Inventor: Han-Joo Yoo, Suwon, Rep. of Korea

[73] Assignee: Samsung Electronics Co., Ltd., Suwon-City, Rep. of Korea

[21] Appl. No.: 08/936,421

[22] Filed: Sep. 24, 1997

[30] Foreign Application Priority Data

Oct. 15, 1996 [KR] Rep. of Korea ..... 96-46005

[51] Int. Cl.[6] ..... F25B 47/02

[52] U.S. Cl. ..... 62/153; 62/126; 62/156

[58] Field of Search ..... 62/151, 153, 156, 62/155, 234, 126, 127, 129, 80, 154

[56] References Cited

U.S. PATENT DOCUMENTS 4,856,287 8/1989 Oike ..... 62/126

5,564,286 10/1996 Suse ..... 62/153

*Primary Examiner*—Harry B. Tanner

*Attorney, Agent, or Firm*—Burns, Doane, Swecker & Mathis, L.L.P.

[57] ABSTRACT

A refrigerator includes a defrosting heater. An outdoor air temperature sensor senses a temperature of outside air. A defrosting time period of the heater is set as a function of the outside air temperature. If it is determined that the temperature sensor is inoperative, i.e., if the sensor indicates that the outside air temperature is above 50° C. or below −50° C., the defrosting period which is set is the same, regardless of whether the sensor indicates the outside air temperature to be above 50° C. or below −50° C.

1 Claim, 4 Drawing Sheets

CONTROL METHOD OF DEFROSTING OPERATION OF A REFRIGERATOR

BACKGROUND OF THE INVENTION

1. Field of the Invention

The present invention relates to a refrigerator, more particularly, to a control method of defrosting operation of a refrigerator.

2. Description of the Prior Art

A cooling process of a conventional refrigerator shown in FIG. 1, is described below. At first, a cooling agent is turned into air of high temperature and high pressure by a compressor (10), subsequently into liquid with low temperature and high pressure through heat transmission with outdoor air in a condenser (12), and finally into transient liquid with low temperature and low pressure for easy evaporation while passing through a capillary tube to flow into a vaporizer or evaporator (14).

The cooling agent of transient liquid enables air in the refrigerator to be cooled or heat-exchanged by evaporation while passing through several pipes of the vaporizer (14), and the cooling agent of vapor with low temperature and low pressure is infused into the compressor (10) for further circulation, where the cooling cycle of the refrigerator is repeated.

The cooled vapor heat-exchanged at the vaporizer (14) is forcibly blown into a freezing chamber (18) and a refrigerating chamber (20) by a ventilating fan (16), so that food in a refrigerator can be kept fresh. A refrigerator damper (22) disposed in the route of the blown cooled vapor keeps the refrigerating chamber (20) at a preset constant temperature (commonly around +3° C.), by controlling supply of cooled vapor from the vaporizer (14).

Frequent opening of a refrigerator door causes inflow of outdoor air, resulting in the formation of frost on the surface of the vaporizer(14) which has to be defrosted by a defroster (24). FIG. 2 is a flowchart illustrating a defrosting operation in the refrigerator. Defrosting operation of the conventional art is described in detail with reference to FIGS. 1 and 2. Table 1 shows a defrosting period of the refrigerator depending on the temperature of outdoor air detected by the outdoor temperature sensor and the number of the uses, i.e., opening and closing use of the refrigerator door in the conventional art.

TABLE 1

Defrosting period depending on each defrosting temperature mode and the number of the uses of the refrigerator door

| | defrosting mode | | |
|---|---|---|---|
| # of uses of door | low temperature mode (under −50° C. or −50° C. to +20° C.) | normal mode (20° C. to 35° C.) | high temperature mode (35° C. to 50° C. or over 50° C.) |
| 2 | 16 hours | 16 hours | 12 hours |
| 3–4 | 16 hours | 12 hours | 12 hours |
| 5 | 12 hours | 12 hours | 6 hours |

In the cooling process of the refrigerator, the temperature of the outside air is detected by an outdoor air temperature sensor. In case the outdoor temperature is over 50° C. or under −50° C., a controller determines the outdoor air temperature sensor as defective and selects the high temperature defrosting mode (steps 310, 312, 314 for the former, and steps 316, 318, 320 for the latter respectively).

When the temperature is detected between 35° C. and 50° C., and between −50° C. and 20° C. by the outdoor air temperature sensor, the high temperature defrosting mode and the low temperature defrosting mode are selected respectively (steps 322, 314 for the first, and steps 322, 324, 320 for the latter respectively). Temperature is detected between 20° C. and 35° C., the controller selects the normal defrosting mode (steps 324, 326).

The controller counts the number of uses of the refrigerator door for a certain period of time (1 hour as recommendable) with a door detecting switch (step 328), and selects the defrosting period correspondingly as in Table 1 (step 330). The controller generates a signal for defrosting operation of the refrigerator according to the selected defrosting period, and thereby the defrosting heater is operated to remove frost on the vaporizer (14) (step 332).

For instance, if temperature detected by the outdoor temperature sensor is between 20° C. and 35° C., the controller selects the normal defrosting mode, selects a defrosting period depending on the counted number of uses of the refrigerator door, and sends a corresponding defrosting signal. Accordingly frost on the vaporizer (14) is removed by the defrosting heater (24).

When the temperature is over 50° C. or under −50° C., in the same manner as described above, the controller determines the outdoor air temperature sensor defective, respectively selects the high temperature defrosting mode or the low temperature defrosting mode, and selects the corresponding defrosting period depending on the number of uses of the refrigerator door.

In case the defrosting mode is selected at the high temperature mode or at the low temperature mode due to the defective outdoor air temperature sensor, the defrosting period of the refrigerator is selected not by actual outdoor air temperature, therefore resulting in weakening of cooling capability or high consumption of electricity.

If the number of the uses of the refrigerator door is over 5 at the low temperature mode, for example, the given defrosting period is 12 hours. However if, the actual outdoor air temperature were between 35° C. and 50° C., so the defrosting period should instead have been 6 hours. As a result, weakening of cooling capability is caused by the difference of the two defrosting periods.

By way of another example, when the detected outdoor air temperature is over 35° C., thereby setting the defrosting mode at the high temperature mode and the number of use of the refrigerator door is under 2, the given defrosting period is 12 hours. However if, the actual outdoor temperature were under 20° C., the defrosting period should instead have been 16 hours. In this case, excessive consumption of electricity results from higher defrosting frequency.

It is an object of the present invention to solve the problems, weakening of the cooling capability and excessive consumption of electricity as described above, by providing a control method of defrosting period of a refrigerator according to the preset defrosting period in case the outdoor air temperature sensor is defective.

SUMMARY OF THE INVENTION

In accordance with the object of the present invention, there is provided a control method of defrosting operation of a refrigerator, the method for determining a defrosting mode by temperature of the outdoor air detected by the outdoor air temperature sensor, the method comprising, measuring the number of use of the refrigerator door by the door detecting switch for selection of a corresponding defrosting period and carrying out the defrosting operation of the refrigerator by operation of the defrosting heater, the method comprising the steps of:

determining as defective the outdoor air temperature sensor in case the temperature detected by the outdoor air temperature sensor exceeds the range of the temperatures designated in the controller;

selecting a defrosting period according to the number of the use of the refrigerator door counted by the door detecting switch; and defrosting on the surface of vapor with the defrosting heater.

DETAILED DESCRIPTION OF THE INVENTION

Figure 1:
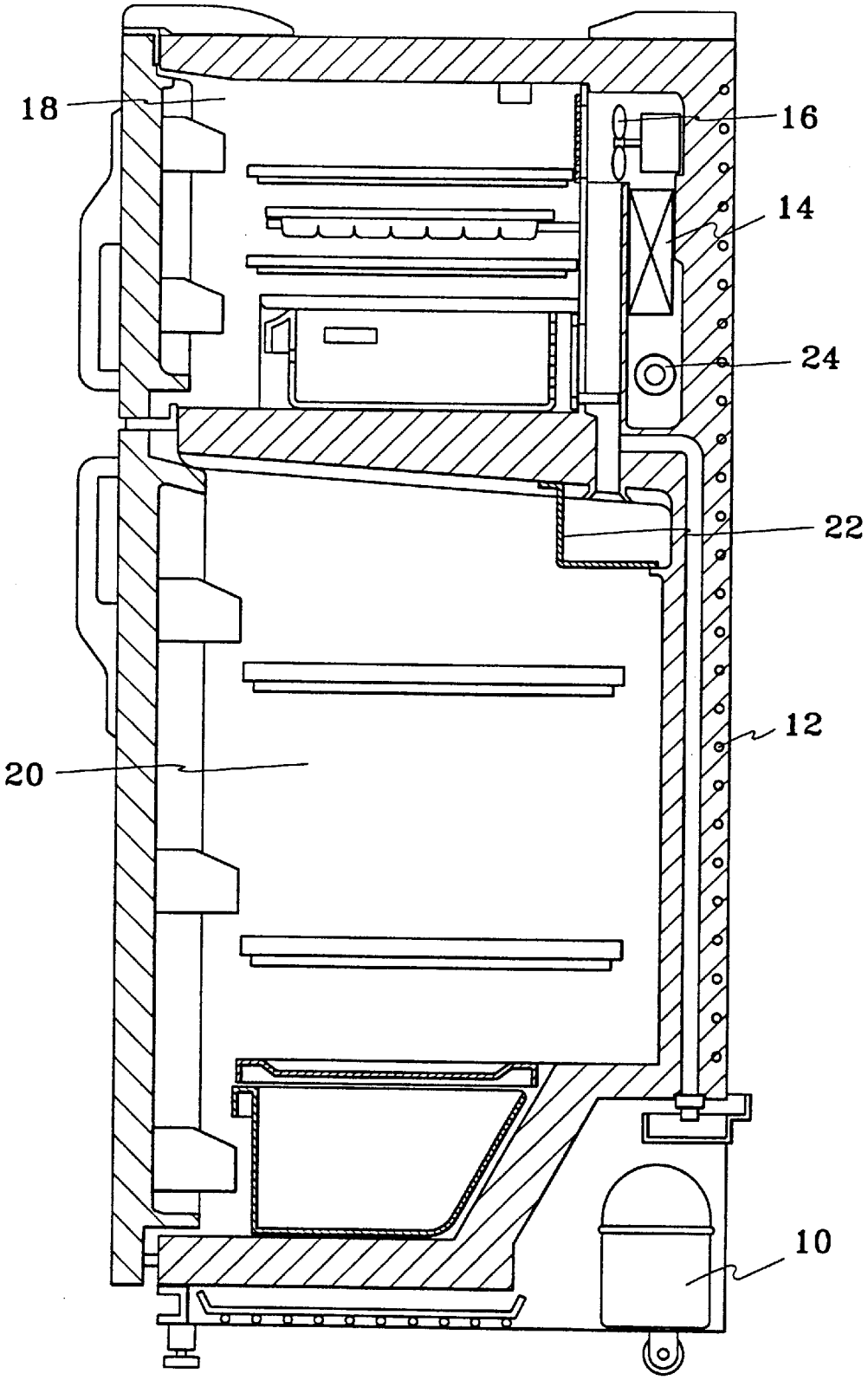
FIG. 1 (PRIOR ART)
FIG. 1 is a detailed view of an inside of a common refrigerator.
Figure 2:
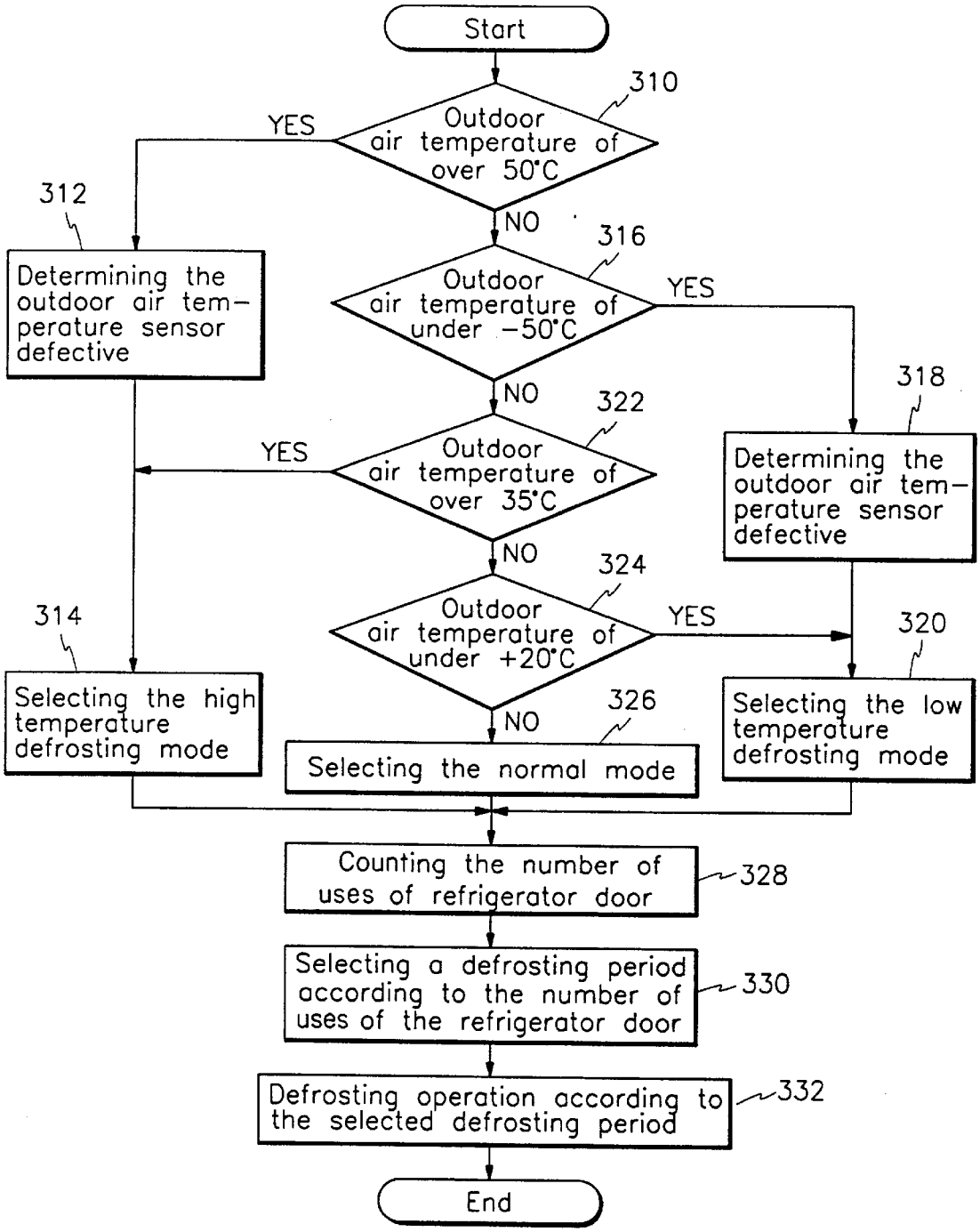
FIG. 2 (PRIOR ART)
FIG. 2 is a flowchart showing defrosting steps in the defrosting operation of a conventional refrigerator.

The present invention is described in detail with reference to a few embodiments. Same structural parts of a refrigerator in the present invention as those in the conventional art are omitted to avoid any repetitive description.

First of all, temperature of outdoor air is detected by the outdoor temperature air sensor. Secondly, the number of the use of the refrigerator door is counted by the door detecting switch. Thus, the information, thereof, is sent to the controller (110). Thirdly, the controller sends a signal to cool the refrigerator with the compressor (10) and the ventilating fan (16).

Accordingly, the defrosting temperature mode is determined depending on the temperature detected by the outdoor air temperature sensor (102), and a defrosting period is selected depending on the number of the use of the refrigerator door for a certain period of time (1 hour as recommendable) with a door detecting switch (104). The controller generates a defrosting signal according to the selected defrosting period.

In case outdoor temperature is over 50° C. or under −50° C., the controller determines the outdoor air temperature sensor defective and accordingly generates a defrosting signal depending on the number of the use of the refrigerator door counted by the door detecting switch (104). Then, the compressor (122) circulates the cooling agent according to the signal from the controller (110), thereby the ventilating fan (16) blowing cooled vapor from the vaporizer (14) into the refrigerating room, and the defroster (126) operates the defrosting heater (24) to remove frost on the surface of the vaporizer (14).

Figure 3:
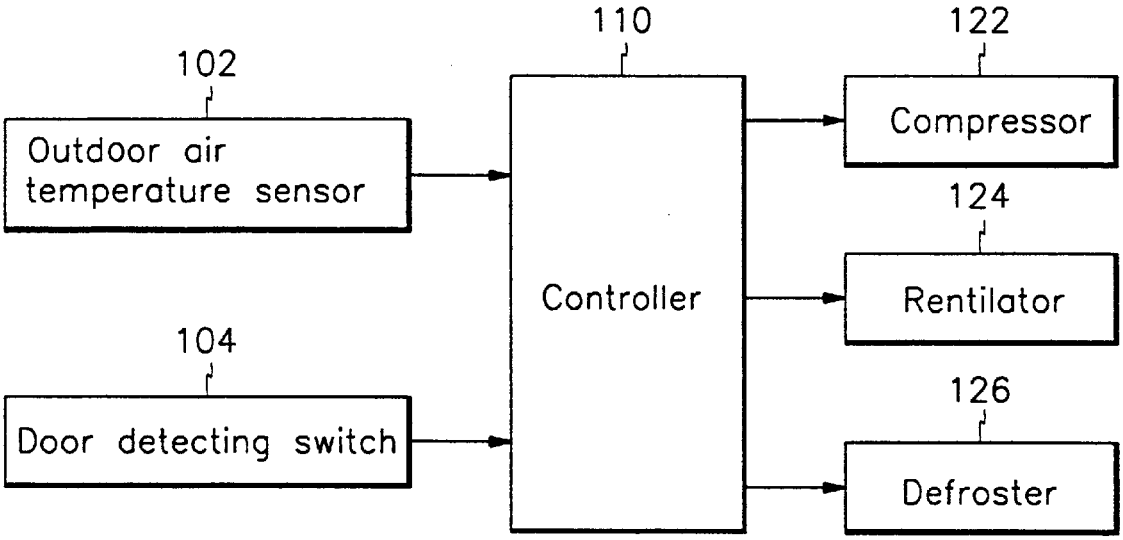
FIG. 3 is a schematic block diagram of the hardware to describe the defrosting steps in accordance with the present invention.
Figure 4:
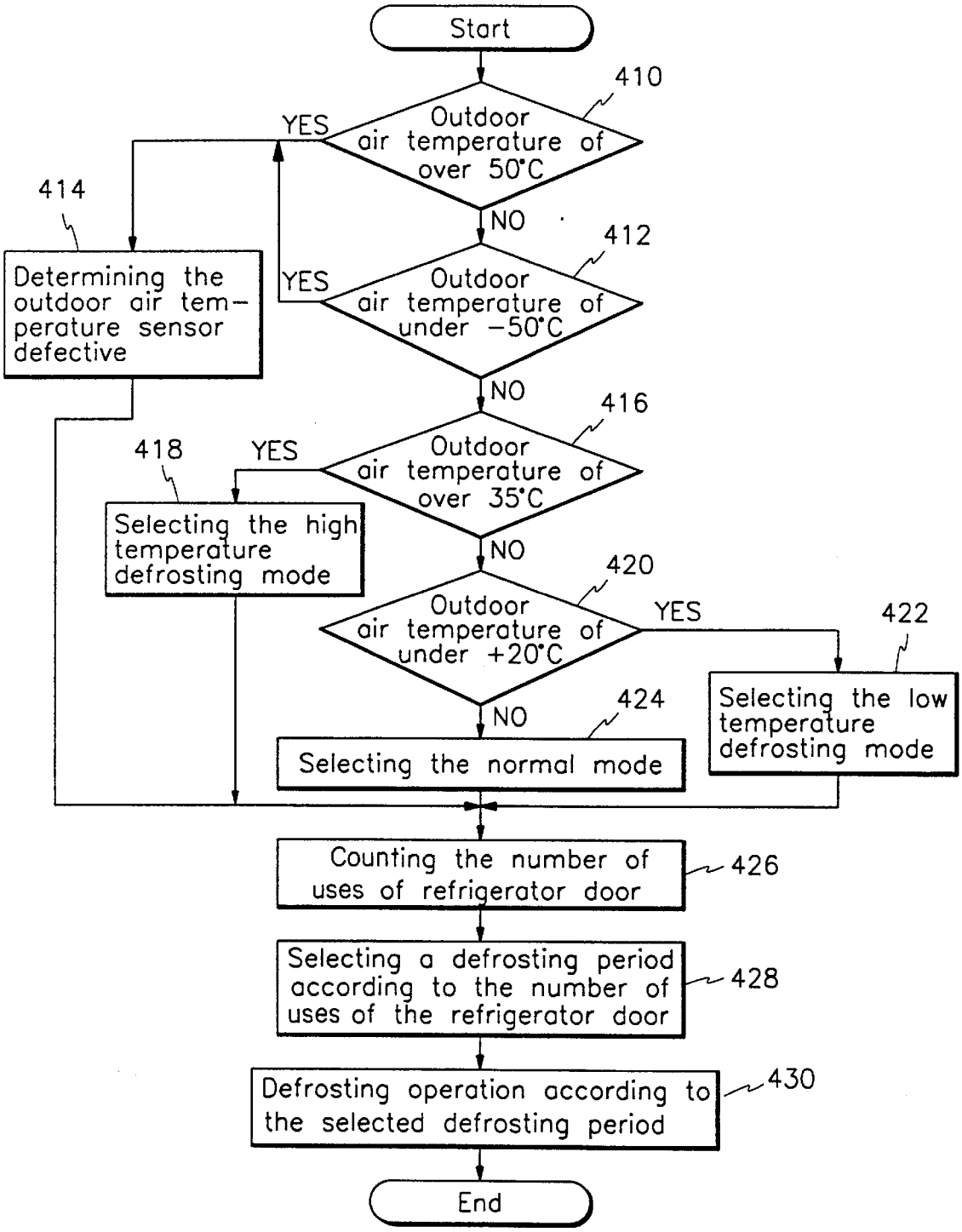
FIG. 4 is a flowchart showing defrosting steps according to an embodiment of the present invention.

The method to control defrosting operation of the refrigerator in the present invention is described in detail with reference to FIGS. 3 and 4. First of all, the defrosting period depending on the temperature detected by the outdoor air temperature sensor (102) and the number of the use of the refrigerator door measured by the door detecting switch (104) are classified as shown in Table 2. Collected information is stored in the controller.

TABLE 2

Defrosting period depending on each defrosting mode and the number of the use of the refrigerator door.

| | Defrosting mode | | | |
|---|---|---|---|---|
| # of uses of door | low temperature mode (−50° C. to +20° C.) | normal mode 20° C. to 35° C.) | high temperature mode (35° C. to 50° C.) | defective mode (under −50° C. or over 50° C.) |
| under 2 | 16 hours | 16 hours | 12 hours | 16 hours |
| 3–4 | 16 hours | 12 hours | 12 hours | 12 hours |
| over 5 | 12 hours | 12 hours | 6 hours | 6 hours |

In operation of the refrigerator the compressor operator (122) starts the compressor (10) to circulate the cooling agent with the signal sent from the controller (110), vaporizer (14) generating cool vapor, the ventilator (124) blowing the cool vapor with the ventilating fan (16) into the refrigerating room, and the defroster (126) starting the defrosting heater (24) to remove frost on the surface of the vaporizer (14).

Temperature of the outdoor air is detected by the outdoor temperature sensor (102). When outdoor temperature is over 50° C. or under −50° C., the controller (110) determines the outdoor air temperature sensor defective, thereby selecting the defrosting mode defective. When outdoor temperature is detected between 20° C. and 35° C., the controller sets the defrosting temperature mode normal (steps 416, 420, 424).

The controller counts the number of the use of the refrigerator door for a certain period of time (1 hour as recommendable) with the door detecting switch (step 426), and selects the defrosting period correspondingly as in by, Table 2 (step 428). The controller (110) generates a defrosting signal according to the selected defrosting period, and thereby the defrosting heater is operated to remove the frost on the vaporizer (14) (step 332).

The following description is about the key art of the present invention to prevent the problems at the defective defrosting mode, such as weakening of cooling capability due to a lengthened defrosting period and excessive electricity consumption due to a shortened defrosting period.

If the number of the uses of the refrigerator door is over 5 at the defective defrosting mode determined by outdoor air temperature of under −50° C., the corresponding defrosting period is 6 hours, just the same duration as in case the actual outdoor air temperature were between 35° C. and 50° C. A defrosting period properly selected by the present invention prevents weakening of cooling capability from increased frost on the vaporizer (14).

For another example, when the detected outdoor air temperature is over 50° C., thereby setting the defrosting mode defective and the number of the use of the refrigerator door is under 2, the given defrosting period is 16 hours, the same as in case the actual outdoor temperature were between −50° C. and 20° C., the corresponding defrosting period is also 16 hours. Therefore, excessive electricity consumption is prevented in the present invention, differently from in the conventional art. It is found effective in the present invention that this method, in case of malfunction of the outdoor air temperature sensor, prevents excessive consumption of electricity due to a shortened defrosting period and weakening of cooling capability due to a lengthened defrosting period.

What is claimed is:

1. A method of defrosting an evaporator of a refrigerator, the refrigerator comprising a food storage compartment, a refrigeration cycle including an evaporator for supplying cold air to the compartment, a heater for defrosting the evaporator, an air temperature sensor for detecting a temperature of the outdoor air, and a door-usage sensor for detecting a number of uses of a door of the refrigerator compartment, the method comprising the steps of:

A) determining the air temperature sensor as defective in case the outdoor air temperature detected by the air temperature sensor is at any value outside of a preselected reference range of temperature values;

B) detecting a number of uses of the door;

C) electing one of a number of different defrosting periods dependent solely on the number of detected door uses when it is determined that the air temperature sensor is defective, the selected defrosting period being independent of whether the temperature value detected by the air temperature sensor is above or below the reference range; and D) actuating the defrosting heater to defrost the evaporator for the selected defrosting period.

* * * * *